US009566469B1

(12) United States Patent
Rector

(10) Patent No.: US 9,566,469 B1
(45) Date of Patent: Feb. 14, 2017

(54) FLEXIBLY CONNECTED ROTARY RESISTANCE EXERCISE DEVICE

(71) Applicant: Michael Alan Rector, Newbury Park, CA (US)

(72) Inventor: Michael Alan Rector, Newbury Park, CA (US)

( * ) Notice: Subject to any disclaimer, the term of this patent is extended or adjusted under 35 U.S.C. 154(b) by 0 days.

(21) Appl. No.: 14/827,384

(22) Filed: Aug. 17, 2015

(51) Int. Cl.

| | |
|---|---|
| ***A63B 22/06*** | (2006.01) |
| ***A63B 21/012*** | (2006.01) |
| ***A63B 21/015*** | (2006.01) |
| ***A63B 21/018*** | (2006.01) |
| ***A63B 23/04*** | (2006.01) |
| ***A63B 21/02*** | (2006.01) |
| ***A63B 21/22*** | (2006.01) |

(52) U.S. Cl.
CPC ..... *A63B 23/0476* (2013.01); *A63B 21/02* (2013.01); *A63B 21/028* (2013.01); *A63B 21/22* (2013.01); *A63B 21/4009* (2015.10); *A63B 21/4034* (2015.10); *A63B 21/4049* (2015.10); *A63B 22/06* (2013.01); *A63B 22/0605* (2013.01); *A63B 23/0482* (2013.01); *A63B 2022/0635* (2013.01); *A63B 2022/0652* (2013.01); *A63B 2210/00* (2013.01); *A63B 2210/50* (2013.01)

(58) Field of Classification Search
CPC ..... A63B 21/00076; A63B 21/0608; A63B 21/012; A63B 21/0125; A63B 21/015; A63B 21/018; A63B 21/22; A63B 21/153; A63B 23/0476; A63B 23/0494; A63B 22/06; A63B 22/0605; A63B 2022/0611;A63B 2022/0617; A63B 2022/0635; A63B 2022/0652; A63B 21/1609; A63B 21/1672; A63B 21/4034
USPC ..... 482/60, 62, 63, 91
See application file for complete search history.

(56) References Cited

U.S. PATENT DOCUMENTS

| | | | | | |
|---|---|---|---|---|---|
| 2,209,034 | A | * | 7/1940 | Paul | A63B 21/023 482/130 |
| 2,673,088 | A | | 3/1954 | Wentz | |
| 3,259,385 | A | | 7/1966 | Boren | |
| 3,722,882 | A | * | 3/1973 | Patrick | A63B 22/0605 482/57 |
| 3,751,033 | A | * | 8/1973 | Rosenthal | A63B 22/0694 482/60 |
| 4,007,927 | A | | 2/1977 | Proctor | |
| 4,114,875 | A | | 9/1978 | Deluty | |
| 4,222,376 | A | | 9/1980 | Prapotnik | |
| 4,225,130 | A | * | 9/1980 | Zimmerman | A63B 22/0007 482/60 |
| 4,262,902 | A | | 4/1981 | Dranselka | |
| 4,265,447 | A | * | 5/1981 | Shafer | A47B 31/06 108/44 |
| 4,293,127 | A | * | 10/1981 | Dudley | A63B 21/1627 482/120 |
| 4,470,594 | A | * | 9/1984 | Pomeroy | A63B 22/0605 482/60 |
| 4,538,804 | A | * | 9/1985 | Zibell | A63B 21/015 482/57 |

(Continued)

*Primary Examiner* — Joshua Lee
(74) *Attorney, Agent, or Firm* — Louis Ventre, Jr.

(57) ABSTRACT

The invention provides an apparatus, system and method for reducing the size of portable rotary motion exercise devices. Flexible materials in contact with the user or a piece of furniture is part of the connection between the user and the exercise device. Multiple wraps of a band around a shaft provide adjustable rotational resistance.

6 Claims, 3 Drawing Sheets

(56) References Cited

U.S. PATENT DOCUMENTS 4,558,861 A * 12/1985 Gall ..... A63B 21/015 188/77 R
4,838,547 A 6/1989 Sterling
4,842,272 A * 6/1989 Jennings ..... A63B 21/015 482/119
5,108,092 A * 4/1992 Hurst ..... A63B 22/0005 482/60
5,147,266 A * 9/1992 Ricard ..... A61H 1/0244 482/131
5,242,340 A * 9/1993 Jerome ..... A63B 21/018 482/116
5,247,853 A 9/1993 Dalebout
5,330,402 A * 7/1994 Johnson ..... A63B 22/0012 482/52
5,490,824 A 2/1996 Wang
5,580,338 A * 12/1996 Scelta ..... A63B 22/0002 482/114
5,643,153 A 7/1997 Nylen et al.
5,647,822 A 7/1997 Avganim
5,807,211 A * 9/1998 Berryhill ..... A63B 21/0552 482/129
5,833,575 A 11/1998 Holslag
5,951,442 A 9/1999 Adams et al.
6,866,618 B2 3/2005 Rusinak-Connors
7,160,231 B2 1/2007 Kazemi
7,351,186 B1 * 4/2008 Herman ..... A63B 21/0125 482/44
7,614,984 B1 * 11/2009 Krull ..... A63B 21/0004 482/131
7,621,852 B2 11/2009 Bowser
7,648,447 B2 1/2010 Andre
7,695,410 B2 4/2010 Kim
8,070,659 B2 12/2011 Gagnon et al.
8,083,656 B2 * 12/2011 Suiter ..... A63B 21/0552 482/126
8,915,667 B2 12/2014 Bingham et al.
8,920,292 B1 12/2014 Myers et al.
8,968,162 B2 3/2015 Jaguan
9,114,278 B1 * 8/2015 Sigel ..... A63B 22/0694
2003/0069110 A1 * 4/2003 Chang ..... A63B 21/015 482/57
2003/0092536 A1 * 5/2003 Romanelli ..... A61H 1/0214 482/60
2006/0094569 A1 * 5/2006 Day ..... A63B 21/015 482/57
2008/0300113 A1 * 12/2008 Battiston ..... A63B 21/012 482/51
2013/0303340 A1 11/2013 Polishuk
2014/0287883 A1 9/2014 Decca

* cited by examiner

FLEXIBLY CONNECTED ROTARY RESISTANCE EXERCISE DEVICE

FIELD OF THE INVENTION

The present invention relates to an exercise apparatus which does not include a user seat from which the device is operated.

DESCRIPTION OF THE RELATED ART

Getting additional exercise is important for improving and maintaining the health of many people. Many people are not able to exercise sufficiently because they lack access to suitable exercise equipment at the time and place they have available to exercise. For many people, stationary type exercise cycles would be considered as suitable exercise equipment were it not for their size, weight, sitting discomfort, or fit limitations.

As shown by U.S. Pat. No. 5,108,092, there are exercise cycles that reduce the size and weight of stationary type exercise cycles by not including a seat as part of the exercise cycle. Use of this type of exercise cycle may not be suitable for many people because it moves relative to the user at higher levels of exercise intensity. Use of this type of exercise cycle may not be suitable for many people because of the lack of resistance range and selection ease provided by the relatively small surface area of the pedaling resistance device that this type of exercise cycle uses.

As shown by U.S. Pat. No. 5,647,822, the deficiency previously stated can be reduced by adding a rigid connection between the exercise cycle and the user or the user's chair. Use of this type of exercise cycle may not be suitable for many people because it is still too large to be easily transported or stored. Use of this type of exercise cycle may not be suitable for many people because of the lack of resistance range and selection ease provided by the relatively small surface area of the pedaling resistance device that this type of exercise cycle uses.

As shown by U.S. Pat. Nos. 4,007,927 and 5,247,853, devices are known for producing pedaling resistance over a larger surface area then that provided by the above type exercise cycles. As shown by U.S. Pat. No. 7,648,447, prior exercise cycles are known that use a larger device for producing pedaling resistance, together with providing rigid attachment to a user's chair. Use of this type of exercise cycle improves upon limitations of exercise cycles with the smaller resistance device, but at the cost of increased weight and size.

As shown by U.S. Pat. No. 7,695,410, exercise cycles are known that provide a rigid attachment to a seat pad that is attached to a user's chair. Use of this type of exercise cycle may not be suitable for many people because or its size and weight, or because its use is restricted to a particular type of chair.

As shown by U.S. Pat. No. 5,580,338, arm exercise cycles are known that are placed on the user's legs. Use of this type of exercise cycle may not be suitable for many people because or its size and weight, or because its use is restricted to only doing arm cycling exercises in a seated position.

Thus, there remains a considerable need for an exercise cycle that is functional, compact, lightweight, adjustable, and versatile. Such an exercise cycle may be used by people that otherwise were unable to find the time and place to use prior exercise cycles.

SUMMARY OF THE INVENTION

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

The present invention provides apparatus and methods for reducing the size while increasing the utility of portable rotary motion exercise devices. The connection between the user and the exercise device is not completely rigid. Multiple wraps of a band around a shaft provide for rotational resistance.

In one aspect, the invention is about the connection between the exercise device and the user. The invention is arranged so that flexible material is in contact with the user, and the user only needs to place their body weight on the flexible material in order to use the exercise device. In other embodiments, the flexible material is held against the user with a belt. In other embodiments, the flexible material is tied to a piece of furniture and the user places their body weight on the furniture in order to use the exercise device.

In one aspect, the invention is about the rotational resistance that is accomplished by wrapping a band around a shaft more than once. Adjusting the tension on the band results in changes in the amount of rotational resistance.

In one aspect, the invention is about an exercise apparatus comprising a support member mechanically connected to an assembly having a rotatable shaft, said shaft having one or more crank arms connected to said shaft and one or more flexible bands, each said band wrapped two or more times around said shaft and mechanically attached to said first support member through a band tension adjusting mechanisms, each said band tension adjusting mechanisms is also attached to said a support member, so that changes in tension on said one or more bands that cause resistance to rotation of said shaft can be preserved. In another aspect, said one or more band tension adjusting mechanisms are comprised of a band tensioning device, wherein said band tensioning device is comprised of a means or mechanism selected from the following list: a screw turning in a member that contacts a band, wherein rotation of said screw causes tension in said band to change; said band passing through a releasable holding device, wherein said band is pulled and said releasable holding device holds the pulled tension on said band; said one or more band tension adjusting mechanisms are comprised of a band tensioning device, wherein said band tensioning device is comprised of one or more bands, each said band permanently attached at distal end to a first rod permanently affixed to said first support member, said band is then wrapped as around said shaft, and then permanently attached at said band near end to a second rod adjustably connected to an upper plate attached to said first support member through a threaded rod upon which said second rod travels, so that rotation of said threaded rod causes.

In one aspect, the invention is about an exercise apparatus comprising a first and a second support members, each said member mechanically connected to an assembly having a rotatable shaft, said shaft having one or more crank arms connected to said shaft, wherein said first support member is equipped with wide feet at the distal end and said second support member is equipped with a weight bearing surface. In another aspect said second support member is comprised of a flexible strap connected to said assembly having a rotatable shaft at a near end and having said weight bearing surface at a distal end. In yet another aspect, said second support member is comprised of a rollable material. In another aspect, said second support member is comprised of a foldable material. In yet another aspect said second support member is comprised of a rigid frame having one or more articulations, wherein said second support member is attached by a pivot to said first elongated frame at a near end and to said weight bearing surface at a distal end. In another aspect one or more of said second support rigid frame articulations is comprised of a lockable pivot.

In one aspect, the invention is about an exercise apparatus, comprising an exercise device having a stand on a distal end and connected to a flexible apparatus; said flexible apparatus comprising means in more than two places to repeatedly bend and unbend without damage and whereby said flexible apparatus contributes to securing said exercise device substantially in place; a shaft and a support apparatus having means of rotationally holding said shaft, a band, said band having a plurality of wraps around said shaft along with and having a means of supporting a tensioning apparatus for said band, wherein said tensioning apparatus has the band tightness adjusting means.

In one aspect, the invention is about an exercise system comprising an exercise device designed for making contact with a rigid surface, connected to a flexible apparatus, wherein said flexible apparatus is comprised of more than two apparatus bending means; wherein said flexible apparatus has user connection means so that the connection of said user to said flexible apparatus contributes to securing said exercise device substantially in place. In another aspect, said flexible apparatus comprises more that two folding means. In yet another aspect said flexible apparatus comprises materials selected from the group consisting of; sheeting, fabrics, mesh, belts, interlinked arrangements such as chain mail, materials connected by a plurality of hinges, multiple hinge assemblies such as flexible mats, and sewn assemblies. In another aspect, said flexible apparatus comprises area that returns to a usable condition after repeatedly subjected to manipulations selected from the group consisting of; more than two folds along a single predetermined direction and rolling along a predetermined direction. In another aspect, the user connects with said flexible apparatus by a means selected from the group consisting of; standing on; kneeling on; sitting on; laying on; strapping to; and placing body weight on an object that is placed on the flexible apparatus. In yet another aspect, said exercise device comprises pedal and crank arm.

In one aspect, the invention is about an exercise system for resistance to rotation comprising; a shaft; a band having a plurality of wraps around said shaft; a support means rotationally holding said shaft and supporting said band tensioning means; said tensioning means causing tension of said band where said band is contacting said shaft; whereby resistance to rotation of said shaft occurs. In another aspect, said band wraps around the shaft more than the number of times selected from the group consisting of three, four, and five. In yet another aspect, said band comprises materials selected from the group consisting of; string, rope, webbing, fiber, fabric, leather, plastic, and rubber. In another aspect, an item selected from the group consisting of; exercise device, rotary motion exercise device, pedal, and crank arm.

Other features and advantages of the present invention will become apparent upon examining the following detailed description of an embodiment thereof, taken in conjunction with the attached drawings.

Figure 1:
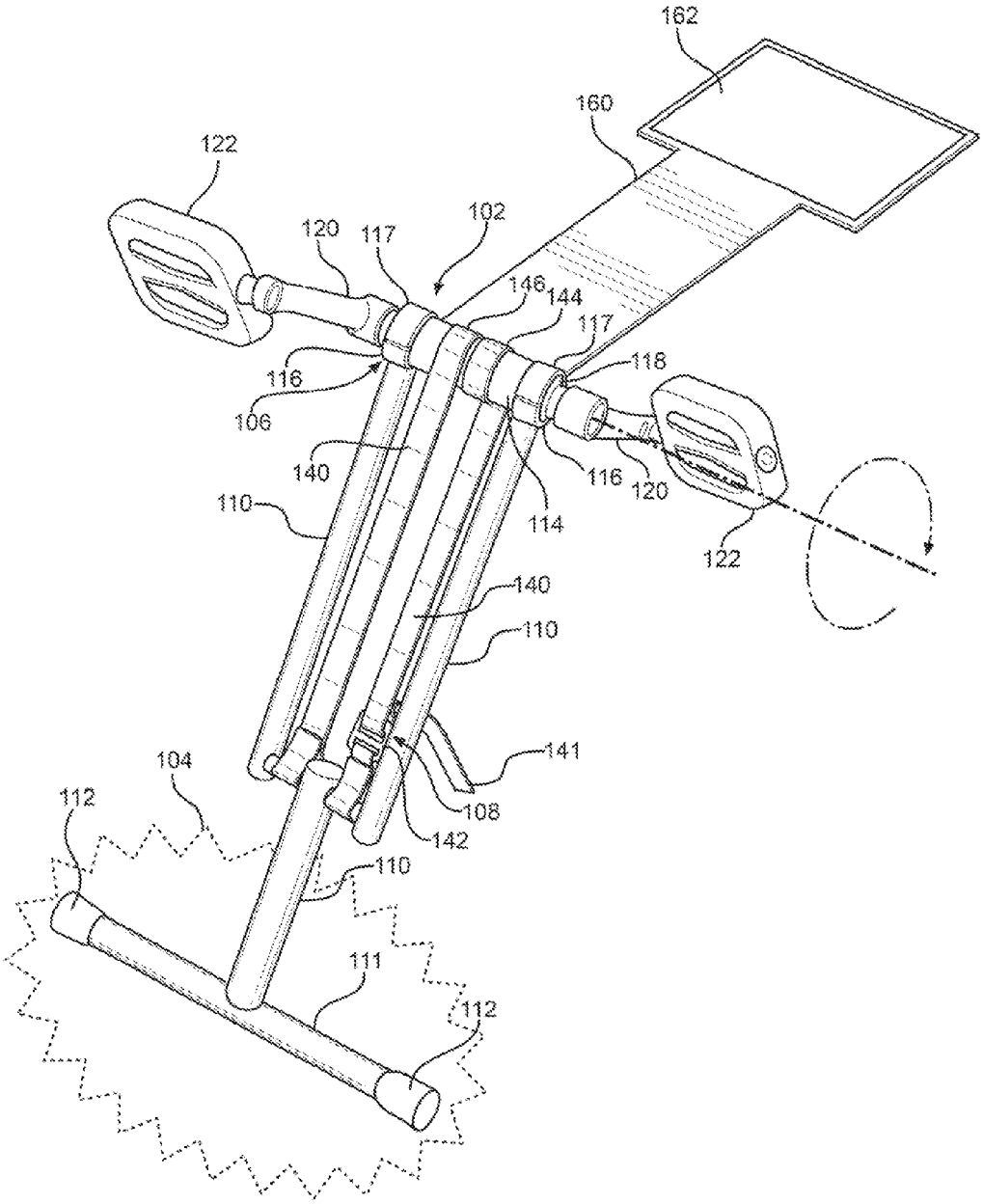
FIG. 1 is a perspective view of an exercise apparatus, according to an exemplary embodiment.

The above-described and other features will be appreciated and understood by those skilled in the art from the following detailed description, drawings, and appended claims.

DETAILED DESCRIPTION OF THE PREFERRED EMBODIMENT

This section is for the purpose of summarizing some aspects of the present invention and to briefly introduce some preferred embodiments. Simplifications or omissions may be made to avoid obscuring the purpose of the section. Such simplifications or omissions are not intended to limit the scope of the present invention.

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

Simplifications or omissions may be made to avoid obscuring the purpose of the section. Such simplifications or omissions are not intended to limit the scope of the present invention. All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise.

Certain terminology is used in the following description for convenience only and is not limiting. The words "lower," "upper," "bottom," "top," "front," "back," "left," "right" and "sides" designate directions in the drawings to which reference is made, but are not limiting with respect to the orientation in which the modules or any assembly of them may be used.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

Referring to FIG. 1 we see an embodiment of an exercise apparatus that does not include a seat. An exercise device 102 is placed on a rigid surface 104 such as a floor or ground surface. The exercise device 102 has a rotary pedal type operation. A support member or frame 110 has a cross bar 111 that has feet 112 that rest on the rigid surface 104. The frame 110 rotatably supports a shaft 114 that is secured to the frame 110 by way of lower bearing holders 116 and upper bearing holders 117 that contain bearings 118. Crank arms 120 are attached to each end of the shaft 114. Pedals 122 are attached to the crank arms 120. A band 140 secured to the frame 110 extends upwards and makes two passes around the shaft 114 and then passes through a tensioning device 142. A second support member may be comprised of a strap or such other flexible apparatus 160 is connected to the frame 110, and the flexible apparatus 160 extends away from the frame 110. Such flexible apparatuses may be both foldable and/or rollable to save storage space.

The embodiment of FIG. 1 is comprised of parts that are for unicycles, such parts being: frame 110; lower bearing holders 116, upper bearing holders 117, bearings 118, crank arms 120, and pedals 122. The lower bearing holders 116 are welded to the frame 110. The upper bearing holders 117 attach to the lower bearing holders 116 by a fastening means such as screws. The cross bar 111 is attached to the frame 110 by welding, clamping, or other means. The feet 112 fit on the ends of the cross bar 111 and are similar to feet used on crutches or chair legs.

The shaft 114 has ends that mate with standard unicycle crank arms. The shaft 114 rotatably rides on the bearings 118. If the shaft 114 has an aluminum surface, that surface may have an anodized coating in the area in contact with a band 140 to reduce squeaking during rotation against the band 140.

In one embodiment, the flexible apparatus 160 is connected to the frame 110 by a means of attachment such as by use of mechanical fasteners. The flexible apparatus 160 is narrower towards the shaft 114 end so that a user's legs are not obstructed during use. The flexible apparatus 160 is wider away from the shaft 114 to provide more area of contact with a user or an object a user's weight is on. A bearing surface 162 is area of the flexible apparatus 160 predetermined for contact with a user or an object a user's weight is placed on.

Exemplary operation of the System of Flexibly Connecting. In one embodiment, a user applies the user's body weight on the bearing surface 162, orientates the frame 110 so that it is upright relative to the rigid surface 104, and places hands or feet onto the pedals 122. A user performs exercise by rotating the pedals 122. A user's weight on the bearing surface 162 keeps that end in place on the ground or chair where a user's weight is applied. A user's weight may be applied directly by actions such as sitting on the bearing surface 162. A user's weight may be applied indirectly by actions such as sitting on a chair that is placed on the bearing surface 162. With a user's weight applied to the bearing surface 162, adequate stiction is created between the bearing surface 162 and the surface onto which the bearing surface 162 is placed, resulting in the frame 110 and all connected parts not slipping away from the user during moderate force use. The frame 110 is held upright by the tension created in the flexible apparatus 160 that counters the forces that a user exerts on the pedals 122.

Holding capacity of the stiction between the bearing surface 162 and a surface onto which it is placed can be augmented or replaced by a means of securing the bearing surface 162 to the user or to an object onto which a user's weight is applied. An example of a means of connecting the bearing surface 162 to the user is the use of straps means connected to or part of the bearing surface 162 being directly secured to a user's body or being secured to a removable belt which in turn is secured to the user's body. An example of a means of connecting the bearing surface 162 to an object onto which the user's weight is applied is to use strings connecting to or part of the bearing surface 162 to tie to frame members of a chair. The use of these or similar means results in the frame 110 and all connected part not slipping away from a user during user's application of heavier forces the pedals 122.

To facilitate storage or transportation, a user may bend or roll the flexible apparatus 160 against the frame 110. To ready for use, a user unrolls or straightens the flexible apparatus 160 and extends the flexible apparatus 160 away from the frame 110.

In one embodiment, the System of Flexibly Connecting contains a flexible apparatus 160 that is made from conveyor belting in this embodiment, however it is envisioned that the flexible apparatus 160 can be made from a wide range of materials or forms that are supple in at least one direction, with examples being: rubber; plastic; leather; sheeting; fabrics; mesh; belts; interlinked arrangements such as chain mail; materials that are not supple that are connected by a plurality of hinges; multiple hinge arrangements such as flexible mats, sewn assemblies; and arrangements using multiple of these. Supple as used herein is defined as a material characteristic where bending and straightening of the material by normal human hands in accordance with predetermined instructions can be done repeatedly at least 100 times without degrading the predetermined usability of that which is supple.

The flexible apparatus 160 in this embodiment is made of supple material that bends without damage along the direction extending away from the exercise device 102 and can be rolled for storage and unrolled for use. The flexible apparatus 160 is also envisioned to be made from materials that are not supple along the entire length extending away from the exercise device 102, examples being but not limited to: sections of the flexible apparatus 160 that are not supple and are joined by supple means; and sections of the flexible apparatus 160 that are not supple and utilize more than two hinges or pivots for connecting sections together and for connecting section to the exercise device 102. In one embodiment, one or more of these are lockable hinges or lockable pivots.

The use of a pivot, hinge or supple material to join sections that are not supple is defined as a fold. With these alternate embodiments, a user may bend or fold the second support member comprised of a strap or flexible apparatus fold the flexible apparatus 160 for storage and straighten the flexible apparatus 160 for use. Fold as used herein is defined as subcategory of the word bend. By definition for use herein, a supple embodiment that can be rolled along a single direction where the supple embodiment contacts itself is considered to have a bend or bending means for every two inches of dimension along the direction of being rolled.

A bending means includes items or arrangements that pivot, hinge, fold, or bend. Where pivot, hinge, fold, and bend are described above, those descriptions are specific examples of bending means. A folding means includes items or arrangements that hinge or fold. Where pivot, hinge and fold are described above, those descriptions are specific examples of folding means.

In one embodiment, a System of Resistance to Rotation is comprised of a band 140 secured to the frame 110 by means such as a sewn loop. The band 140 wraps around the shaft 114 two times, however more wraps may be done to increase rotational resistance. After the final wrap of the band 140 around the shaft 114 the band 140 passes through the tensioning device 142. The tensioning device 142 is a webbing buckle attached to the frame 110 by a sewn loop of webbing and through which the band 140 is frictionally looped.

In one embodiment, the Operation of the System of Resistance to Rotation is comprised of a band 140 tightened by a user pulling upward on an end 141 of the band 140 where it exits the tensioning device 142. This pulling moves the band 140 through the tension device 142 where the band 140 is frictionally held in place after pulling stops. With the shaft 114 rotating in the direction indicated in FIG. 2, this shortening of the band 140 causes a first wrap 144 of the band 140 around the shaft 114 to tighten, and this causes greater rotational resistance between the first wrap 144 of the band 140 and the shaft 114 when rotating.

The increased rotational resistance of the first wrap 144 of the band 140 around the shaft 114 increases the tension and therefore rotational resistance of a second wrap 146 of the band 140 around the shaft 114. Thereby tightening the band 140 increases rotation resistance that a user experiences when moving the one or more pedals 122. The band 140 is loosened by a user by rotating the tensioning device 142 into an orientation where friction on the band 140 is reduced and tension on the band 140 is released. Loosening tension on the band 140 reduces rotation resistance that a user experiences when moving the one or more pedals 122.

In one embodiment, the addition details of the System of Resistance to Rotation comprised a shaft 114 rotating in the direction shown in FIG. 1, the rotational resistance of the first wrap 144 amplifies the tension on and therefore the rotational resistance of the second wrap 146. This amplification means increases if additional partial or full wraps of the band 140 around the shaft 114 are in other embodiments. The shaft 114 may rotate in the opposite direction shown in FIG. 1 and the rotational resistance of the second wrap 146 amplifies the tension and therefore the rotational resistance of the first wrap 144, providing the holding ability of the tensioning device 142 on the band 140 is not exceeded.

The band 140 is polyester webbing in this embodiment, but the band 140 may be made from a wide variety of materials or collection of materials including: string, rope, webbing, fiber, fabric, leather, plastic, and rubber. In addition to the means of a webbing buckle attached to the frame 110 by a sewn loop of webbing, the tensioning device 142 can be any means of tensioning and loosening the band 140, including utilizing screws, turnbuckles, cam buckles, or ratchet buckles. Means of attaching the tensioning device 142 are envisioned to include: sewn materials; loops of webbing secured with bent metal rings; and fasteners.

The exercise device 102 is comprised of: a support apparatus 106; a tensioning apparatus 108; the frame 110 which has the cross bar 111 that has the feet 112; the crank arms 120; and the pedals 122.

A support means is exemplified by the support apparatus 106 in this embodiment. The support apparatus 106 has a means of rotationally holding the shaft 114 and has a means of supporting a tensioning apparatus 108. The support apparatus 106 is comprised of: the frame 110 that supports the shaft 114 that is secured to the frame 110 by way of the lower bearing holders 116 and the upper bearing holders 117 that contain the bearings 118; and the frame 110 that has connection means for the tensioning apparatus 108.

A tensioning means is exemplified by the tensioning apparatus 108 in this embodiment. The tensioning apparatus 108 has a means of changing the tightness of the band 140 where in contact with the shaft 114. The tensioning apparatus 108 comprises: the band 140 being secured to the frame 110; the band 140 passing around the shaft 114; the band 140 passing through the tensioning device 142; the loose end 141 of the band 140; and the tensioning device 142.

In one embodiment, the Operation and Variations of FIG. 1 exemplary embodiment means that with the system of flexibly connecting and the system of resistance to rotation of the embodiment of FIG. 1, a user has a versatile and compact exercise device 102. The system of flexibly connecting enables the exercise device 102 to have small size, light weight, and a wide selection of usage configurations such as: arm or leg exercise; exercise from a standing, kneeling, sitting, or laying position; and unattached, attachable, or attached to furniture or body belts. The system of resistance to rotation enables the exercise device 102 to have small size, light weight, and a range of rotational resistance adjustment by simple user actions. Having both the system of flexibly connecting and the system of resistance to rotation together enables a smaller size and a lighter weight variable resistance range rotary pedal exercise device.

Envisioned are embodiments where the system of flexibly connecting and the system of resistance to rotation are separately utilized. The system of flexibly connecting enables the exercise device 102 to have small size, light weight, and a wide selection of usage configurations such as: arm or leg exercise; exercise from a standing, kneeling, sitting, or laying position; and unattached, attachable, or attached to furniture or body belts. The system of resistance to rotation enables the exercise device 102 to have small size, light weight, and a range of rotational resistance adjustment by simple user actions.

Figure 2:
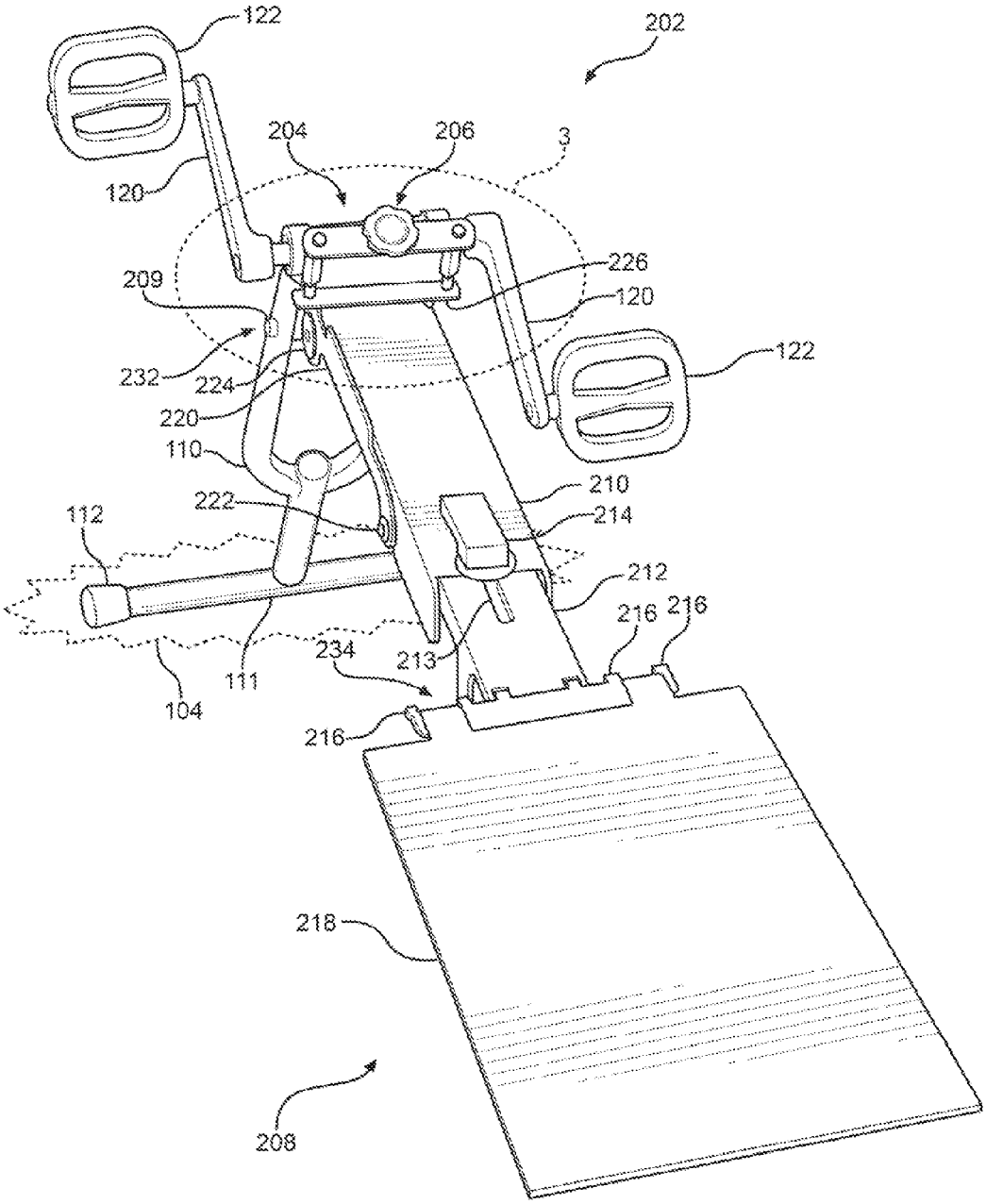
FIG. 2 is a perspective view of another exercise apparatus, according to an exemplary embodiment.
Figure 3:
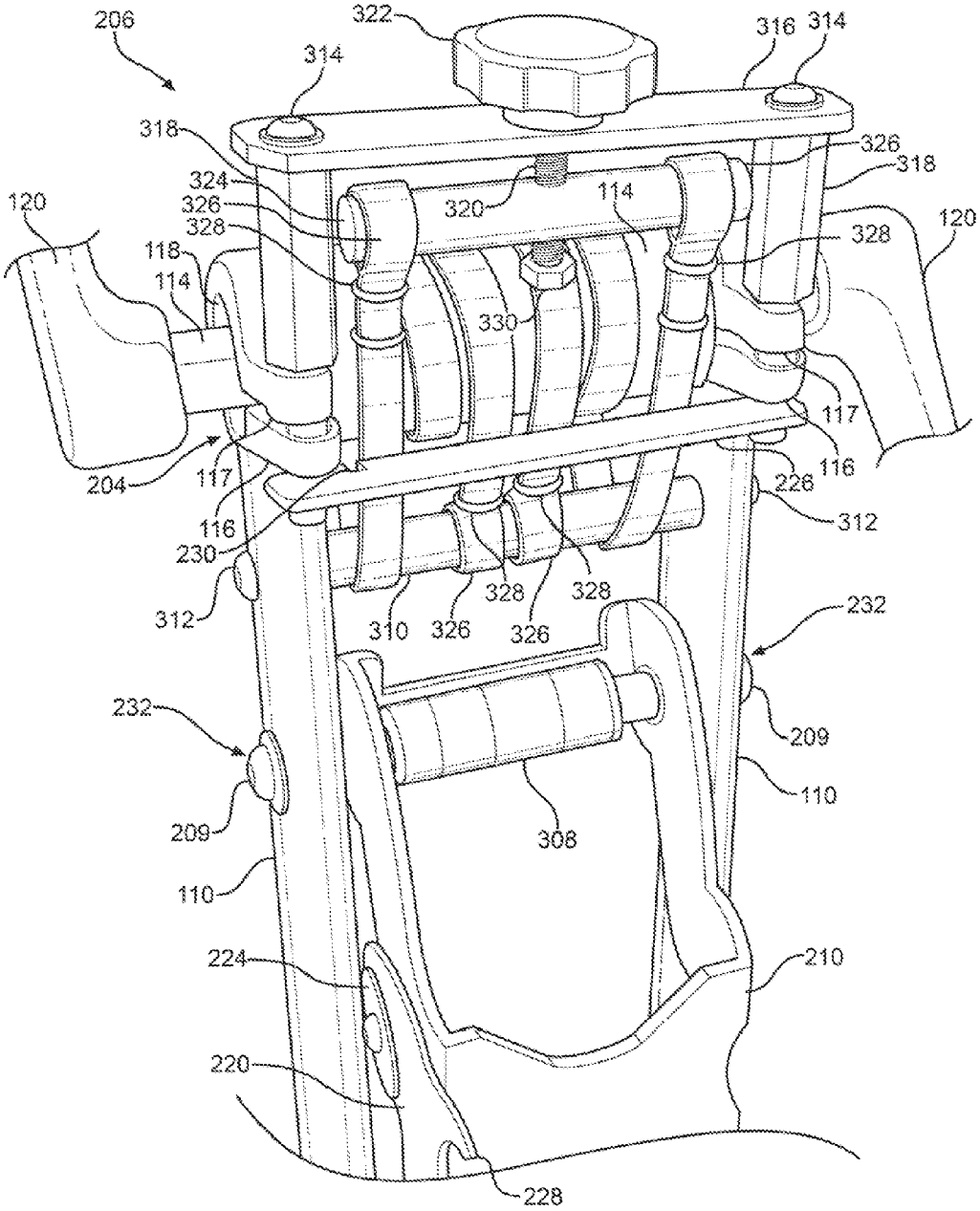
FIG. 3 is a partial perspective view of the exercise apparatus of FIG. 2, according to an exemplary embodiment.

Referring to FIGS. 2-3, FIG. 2 shows another embodiment of an exercise apparatus that does not include a seat. An exercise device 202 is placed on a rigid surface 104 such as a floor or ground surface. The exercise device 202 has a rotary pedal type operation. A frame 110 has a cross bar 111 that has feet 112 that rest on the rigid surface 104. The frame 110 supports a shaft 114 that is secured to the frame 110 by way of lower bearing holders 116 and upper bearing holders 117 that contain bearings 118. Crank arms 120 are attached to each end of the shaft 114. Pedals 122 are attached to the crank arms 120. These items have the same characteristics as described for the embodiment of FIG. 1.

In one embodiment, the system of Flexibly Connecting with Multiple Components comprises the exemplary embodiment of FIG. 2 shows a flexible apparatus 208 comprising multiple components. An outer channel 210 is attached to frame 110 with screws 209 that pass through holes in the frame 110. An inner channel 212 slides within the outer channel 210. A locking device 214 provides a means to permit or prevent the inner channel 212 from sliding in the outer channel 210. A cross member 216 attaches to the inner channel 212. A bearing surface 218 is attached to the cross member 216.

Referring to FIG. 3, which shows a partial close up view of the embodiment of FIG. 2. In FIG. 2, the flexible apparatus 208 is shown in an extended position. In FIG. 3, the flexible apparatus 208 is shown in a folded condition. Additional components serve to selectively facilitate or prevent movement of the flexible apparatus 208 relative to the frame 110. A catch 220 is attached to the outer channel 210 with a catch pivot 222. A catch spring mechanism 224 resiliently restrains the catch 220 to the outer channel 210. A lower plate 226 is attached to the lower bearing holders 116 using screws 314. A notch 230 in the lower plate 226 receives a hook 228 on the catch 220 when the flexible apparatus 208 is in the extended position, and this locks the flexible apparatus 208 into the extended position.

When a user presses onto the top of the catch 220, the catch spring mechanism 224 is depressed and the hook 228 on the catch 220 clears the notch 230, and then the flexible apparatus 208 can be moved to the folded condition. These additional components provide lockable pivot means for portion of the flexible apparatus 208 which is useful to keep the exercise device 202 from moving more than a predetermined amount during high pedaling forces. It is envisioned that these additional components may be removed from this embodiment and functionality is still present.

In on embodiment, the system allows for the operation of the System of Flexibly Connecting with Multiple Components. Using the embodiment of FIGS. 2 and 3, a user applies the user's body weight on the bearing surface 218 of the flexible apparatus 208, orientates the frame 110 so that it is upright relative to the rigid surface 104, and places hands or feet onto the pedals 122. The user performs exercise by rotating the pedals 122. The user's weight on the bearing surface 218 keeps that end in place on the ground or chair where the user's weight is applied. The user's weight may be applied directly by actions such as sitting on the bearing surface 218. The user's weight may be applied indirectly by actions such as sitting on a chair that is placed on the bearing surface 218. With the user's weight applied to the bearing surface 218, adequate stiction is created between the bearing surface 218 and the surface onto which the bearing surface 218 is placed, resulting in the frame 110 not slipping away from the user during moderate force use.

Holding capacity of the stiction between the bearing surface 218 and a surface onto which it is placed can be augmented or replaced by securing the bearing surface 218 to the user or to an object onto which the user's weight is applied. An example of connecting the bearing surface 218 to the user is the use of straps connected to or part of the bearing surface 218 being directly secured to the user's body or being secured to a removable belt which in turn is secured to the user's body. An example of connecting the bearing surface 218 to an object onto which the user's weight is applied is to use strings connecting to or part of the bearing surface 218 to tie to frame members of a chair. The use of these or similar means results in the frame 110 not slipping away from the user during heavier force use.

Different size users can adjust distance between the bearing surface 218 and the pedals 122 to achieve optimal utilization. A user releases the locking device 214, slides the inner channel 212 relative to the outer channel 210 to achieve a desired combined length, then engages the locking device 214 to fix the combined length of the inner channel 212 and the outer channel 210. This operation of adjusting distance is optional. Embodiments are envisioned where the inner channel 212 and the outer channel 210 are replaced with a single part of fixed length, and the locking device 214 is not required.

To facilitate storage or transportation, a user may fold the outer channel 210 to be against the frame 110. A user presses on the catch 220 to release the hook 228 from engagement with the 230 notch, and then rotates the outer channel 210 into a direction where it is against the frame 110. To ready for use, a user rotates the outer channel 210 to extend away from the frame 110 until the hook 228 engages into the notch 230. This pivot means of folding and extending is optional. Embodiments are envisioned where the outer channel 210 is fixed to the frame 110 in a more permanent manner.

In one embodiment, the additional Details for the System of Flexibly Connecting with Multiple Components shows how the outer channel 210 is metal. A tube 308 passes freely through holes in the outer channel 210. Screws 209 pass through holes in the frame 110 and engage threads in the ends of the tube 308. The outer channel 210 is thereby restrained relative to the frame 110 and is yet able to pivot about the axis formed by the tub 308. Thereby a pivot means is accomplished.

The inner channel 212 is metal and is shaped so that it freely slides within the internal dimensions of the outer channel 210. The locking device 214 could be any means that secures the inner channel 212 relative to the outer channel 210, an example being a cam lever clamp mechanism. The inner channel 212 has a slot 213 that clears the locking device 214 as the inner channel 212 moves to alternate positions. Means to increase friction may be used on the inner channel 212 or the outer channel 210 to prevent sliding when the locking device 214 is engaged, examples of such means including slots in the metal, surface coatings with rough or sticky surfaces, or application of friction tape.

The cross member 216 is shaped metal that has a means for attaching to receiving features in the inner channel 212, with such means including interlocking pins or hooks engaging in a removable manner with holes or slots, or more permanent arrangements using mechanical pivots, hinges, fasteners, or welding. The cross member 216 has means such as notches for attachment with the bearing surface 218. The bearing surface 218 rotatably attaches to the cross member 216 by a folding means such as having the cross member 216 rotatably pass through material loops that are part of the bearing surface 218. The cross member 216 may optionally attach with the bearing surface 218 by fastening means such as screws, grommets, and pins. The cross member 216 can be narrower or wider than shown in FIG. 2. A narrow cross member 216 is more useful when a user sits directly on the bearing surface 218, as a wider cross member 216 may interfere with the user's legs during use. A wide cross member 216 is more useful when a user sits on a chair that in turn is placed on the bearing surface 218, as a more stable connection with chair legs is achieved.

The catch spring mechanism 224 is a means of resiliently supporting and restraining the catch 220, with such means for example being provided by resilient material being placed to hold the catch 220 in a predetermined position, and this same resilient material permitting a predetermined amount of movement of the catch 220 in response to a predetermined amount of force directionally applied to the catch 220.

As described above, the flexible apparatus 208 in this embodiment is made from multiple components. A pivot 232 is formed by the tube 308 rotatably passing through the outer channel 210. A fold 234 is formed by the bearing surface 218 being rotatably attached to the cross member 216. The fold 234 is also formed by the cross member flexibly connecting with the inner channel 212. The fold 234 can be optionally formed by the bearing surface 218 being able to flex adjacent to where the bearing surface 218 is optionally firmly attached to the cross member 216. The pivot 232 and fold 234 are locations within the flexible apparatus 218 that fold. The word pivot or hinge as used here is defined as a subcategory of the word fold. Fold as used herein is defined as subcategory of the word bend.

The bearing surface 218 in this embodiment is supple. Supple as used herein is defined as a material characteristic where bending and straightening of the material by normal human hands in accordance with predetermined instructions can be done repeatedly at least 100 times without degrading the predetermined usability of the material. By definition for use herein, a supple embodiment that can be rolled along a single direction where the supple embodiment contacts itself is considered to have a bend for every two inches of dimension along the direction of being rolled. It is envisioned that supple materials or supple assemblage of materials examples include: rubber; plastic; leather; sheeting; fabrics; mesh; belts; interlinked arrangements such as chain mail; materials that are not supple that are connected by a plurality of hinges; multiple hinge arrangements such as flexible mats, sewn assemblies; and arrangements using multiple of these.

A bending means includes items or arrangements that pivot, hinge, fold, or bend. Where pivot, hinge, fold, and bend are described above, those descriptions are specific examples of bending means.

Means of attaching the bearing surface 218 to the cross member 216 include but are not limited to: sewing; looping; mechanically fastening; and bonding. The bearing surface 218 may include or have provisions for securing the bearing surface 218 to a piece of furniture or to the user, such inclusions or provisions including but not limited to: strings extending from the edges that permit securing to furniture; straps extending from the edges that connect to or form a belt that can be secured to a users body.

In one embodiment, the system of Resistance to Rotation is shown in the embodiment of FIG. 2 together with the detail view of FIG. 3 shows components and arrangements providing adjustable resistance to movement of the coupled pedals 122, crank arms 120, and shaft 114. A lower rod 310 is secured to the frame 110 using screws 312 passing through holes in the frame 110. Screws 314 secure together an upper plate 316, spacers 318, upper bearing holders 117, lower bearing holders 116, and the lower plate 226. A threaded rod 320 is attached to a knob 322. The threaded rod 320 rotatably passes through a hole in the upper plate 316 and threads into a receiving threaded hole in a upper rod 324. Bands 326 are secured to the lower rod 310 with rings 328. Each of the bands 326 wrap around the shaft 114 two times and then pass under the lower rod 310. The bands 326 then loop around the upper rod 324 with rings 328 securing the loop.

The length of the bands 326 are predetermined so that the bands 326 are under tension when the upper rod 324 has been moved to nearly touching the upper plate 316 by the screwing action of the thread rod 320 rotating in conjunction with user clockwise rotation of the knob 322. The length of the threaded rod 320 is predetermined so that the bands 326 are not under tension when the upper rod 324 has been moved to nearly touching a lock nut 330 by the screw action of the threaded rod 320 rotating in conjunction with user counter clockwise rotation of the knob 322. The lock nut 330 is threaded onto the threaded rod 320 to prevent the threaded rod 320 from being completely unscrewed from the upper rod 324 by user counter clockwise rotation of the knob 322.

In one embodiment, additional Details for the System of Resistance to Rotation show the exercise device 202 is comprised of: a support apparatus 204; a tensioning apparatus 206; the frame 110 which has the cross bar 111 that has the feet 112; the crank arms 120; and the pedals 122.

A support means is exemplified by the support apparatus 204 in this embodiment. The support apparatus 204 has a means of rotationally holding the shaft 114 and has a means of supporting a tensioning apparatus 206. The support apparatus 204 is comprised of: the frame 110 that supports the shaft 114 that is secured to the frame 110 by way of the lower bearing holders 116 and upper bearing holders 117 that contain the bearings 118; and the frame 110 that has connection means for the tensioning apparatus 206.

A tensioning means is exemplified by the tensioning apparatus 206 in this embodiment. The tensioning apparatus 206 has a means of changing the tightness of the bands 326 where in contact with the shaft 114. The tensioning apparatus 206 comprises the following. The lower rod 310 is round metal that has threaded holes in each end to engage with the screws 312. The screws 312 are common metal threaded type with a head. The upper plate 316 and the lower plate 226 are metal. The screws 314 are common metal threaded type with a head. The lower plate has threaded holes to receive the threads of the screws 314. The threaded rod 320 is metal and is secured into the knob 322 by adhesive or other means. The knob 322 is plastic. The upper rod 324 is metal. The rings 328 are metal type commonly know as hog rings, and are deformed by a crimping action to effect the fastening together of the end loops of the bands 326. The lock nut 330 is a common metal type that has a plastic insert to prevent inadvertent loosening.

The bands 326 are polyester webbing, but the bands 326 may be made from a wide variety of materials or collection of materials including: string, rope, webbing, fabric, plastic, and rubber. The rings 328 may not be used and the bands 326 end loops may alternately be secured by sewing. Each of the bands 326 wraps around the shaft 114 two times, however more wraps may be done to increase rotational resistance. Envisioned is an embodiment with three or four wraps of the each of the bands 326 around the shaft 114. Envisioned are embodiments where only one of the bands 326 or both of the bands 326 wraps more than two times around the shaft 114 with different arrangement between a means of fixing one end of the one or both bands 326 to a fixed location, and with a means of fixing the other end of one or both bands 326 to a means of user adjustment of the tension of one or both bands 326. The amplification means described for the embodiment of FIG. 1 also applies for the embodiment of FIGS. 2 and 3.

In one embodiment, the operation and Variations of FIGS. 2 and 3 show that the embodiment together with the system of flexibly connecting and the system of resistance to rotation of the embodiment of FIGS. 2 and 3, a user has a versatile and compact arrangement of the exercise device 202. The system of flexibly connecting enables the exercise device 202 to have small size, light weight, and a wide selection of usage configurations such as: arm or leg exercise; exercise from a standing, kneeling, sitting, or laying position; and unattached, attachable, or attached to furniture or body belts. The system of resistance to rotation enables the exercise device 202 to have small size, light weight, and a wide range of rotational resistance adjustment by simple user actions. Having both the system of flexibly connecting and the system of resistance to rotation together enables a smaller size and a lighter weight full resistance range rotary pedal exercise device.

Envisioned are embodiments where the system of flexibly connecting and the system of resistance to rotation are separately utilized. The system of flexibly connecting enables the exercise device 202 to have small size, light weight, and a wide selection of usage configurations such as: arm or leg exercise; exercise from a standing, kneeling, sitting, or laying position; and unattached, attachable, or attached to furniture or body belts. The system of resistance to rotation enables the exercise device 202 to have small size, light weight, and a wide range of rotational resistance adjustment by simple user actions.

REFERENCE NUMERALS IN DRAWINGS

102 exercise device
104 rigid surface
106 support apparatus
108 tensioning apparatus
110 frame
111 cross bar
112 feet
114 shaft
116 lower bearing holders
117 upper bearing holders
118 bearings
120 crank arms
122 pedals
140 band
141 end
142 tensioning device
144 first wrap
146 second wrap
160 flexible apparatus
162 bearing surface
202 exercise device
204 support apparatus
206 tensioning apparatus
208 flexible apparatus
209 screws
210 outer channel
212 inner channel
213 slot
214 locking device
216 cross member
218 bearing surface
220 catch
222 catch pivot
224 catch spring mechanism
226 lower plate
228 hook
230 notch
232 pivot
234 fold
308 tube
310 lower rod
312 screws
314 screws
316 upper plate
320 threaded rod
322 knob
324 upper rod
326 bands
328 rings
330 lock nut

CONCLUSION

Thus the reader will see that at least one embodiment provides a lightweight, compact, functional, yet economical device that can be used by persons of almost any age. While my above description contains many specificities, these should not be construed as limitations on the scope, but rather as an exemplification of several embodiments thereof.

Thus, specific compositions and methods of a flexibly connected rotary resistance exercise device have been disclosed. It should be apparent, however, to those skilled in the art that many more modifications besides those already described are possible without departing from the inventive concepts herein. The inventive subject matter, therefore, is not to be restricted except in the spirit of the disclosure. Moreover, in interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

In concluding the detailed description, it should be noted that it would be obvious to those skilled in the art that many variations and modifications can be made to the* preferred embodiment without substantially departing from the principles of the present invention. Also, such variations and modifications are intended to be included herein within the scope of the present invention as set forth in the appended claims. Further, in the claims hereafter, the structures, materials, acts and equivalents of all means or step-plus function elements are intended to include any structure, materials or acts for performing their cited functions.

It should be emphasized that the above-described embodiments of the present invention, particularly any "preferred embodiments" are merely possible examples of the implementations, merely set forth for a clear understanding of the principles of the invention. Any variations and modifications may be made to the above-described embodiments of the invention without departing substantially from the spirit of the principles of the invention. All such modifications and variations are intended to be included herein within the scope of the disclosure and present invention and protected by the following claims.

The present invention has been described in sufficient detail with a certain degree of particularity. The utilities thereof are appreciated by those skilled in the art. It is understood to those skilled in the art that the present disclosure of embodiments has been made by way of examples only and that numerous changes in the arrangement and combination of parts may be resorted without departing from the spirit and scope of the invention as claimed. Accordingly, the scope of the present invention is defined by the appended claims rather than the forgoing description of embodiments.

The invention claimed is:

1. An exercise apparatus comprising:

a support member having a top end and a bottom end opposite the top end, the support member configured so that a vertical orientation of the support member is changeable by moving the top end with respect to a fixed position of the bottom end resting on a rigid surface, the support member comprising a bearing holder affixed near the top end of the support member;

a flexible mat comprising a planar bearing surface;

the flexible mat attached to the support member near the top end of the support member;

the planar bearing surface configured to rest on a support structure that is vertically displaced above the rigid surface supporting the bottom end of the support member and displaced a horizontal distance from the support member;

a shaft comprising a bearing, the bearing secured within the bearing holder so that the shaft is held at approximately a right angle to the support member, the bearing enabling rotation of the shaft;

two crank shafts attached to the shaft at opposing ends of the shaft, each crank shaft comprising a pedal at a distal end of the crank shaft; and a pliant band having a first end and a second end, the pliant band wrapped two or more times around said shaft and held taut by securing the first end and the second end to the support member.

2. The exercise apparatus of claim 1, further comprising a band tensioning device, wherein said band tensioning device is selected from the group consisting of a screw turning in a member that contacts the pliant band, wherein rotation of said screw causes a change in tension of said pliant band;

a releasable holding device, wherein adjustment and setting of the length of said pliant band through said releasable holding device causes tension of said pliant band to change; and a first rod and a second rod, wherein the first end of the pliant band is permanently attached to the first rod, the first rod is permanently affixed to said support member, and the second end is permanently attached to the second rod, wherein said second rod is adjustably connected through the screw turning member to a third attachment point affixed to the support member through a threaded rod upon which said second rod travels, so that rotation of said threaded rod causes a change in the tension of the pliant band.

3. An exercise system comprising:

a shaft;

one or more crank arms;

a band tensioning means;

a support means rotationally holding the shaft and supporting the band tensioning means;

a flexible mat attached to the support means near a top end of the support means;

a planar bearing surface configured to rest on a support structure that is vertically displaced above a rigid surface supporting a bottom end of the support means and displaced a horizontal distance from the support means;

a first band, the first band restrained to the support means and wrapped around the shaft a plurality of times;

a second band, the second band restrained to the support means and wrapped around the shaft a plurality of times;

the band tensioning means configured to change tension within the first band and the second band against the shaft, the tension when increased causing resistance to rotation of the shaft and the one or more crank arms to increase;

a threaded screw;

a member defining a threaded hole configured to receive the threaded screw;

the first band restrained to said member where the threaded screw is configured to receive the member;

the second band restrained to said member on a side opposite to where the threaded screw is configured to receive the member; and the member configured so that rotation of said threaded screw causes resistance to rotation of said one or more crank arms.

4. The exercise system of claim 3 wherein: said first band and said second band are formed from a material or a collection of materials selected from the group consisting of string, rope, webbing, fiber, fabric, leather, plastic, and rubber.

5. The exercise system of claim 3 further comprising:

a second support, the second support pivotally connected to the support means;

a lock, the lock when engaged prevents the second support from substantially pivotally moving relative to the support means.

6. The exercise system of claim 3 further comprising:

a second support, the second support pivotally connected to the support means; and a flexible material configured to provide a weight bearing surface, the flexible material detachably connected to the second support.

* * * * *